United States Patent [19]

Chimoto

[11] Patent Number: 4,949,132

[45] Date of Patent: Aug. 14, 1990

[54] LOW PRESSURE HEAT FIXING DEVICE

[75] Inventor: Ikurou Chimoto, Osaka, Japan

[73] Assignee: Minolta Camera Kabushiki Kaisha, Osaka, Japan

[21] Appl. No.: 241,571

[22] Filed: Sep. 8, 1988

[30] Foreign Application Priority Data

Sep. 10, 1987 [JP] Japan ..... 62-226934

[51] Int. Cl.[5] ..... G03G 15/20

[52] U.S. Cl. ..... 355/290; 219/216; 432/60

[58] Field of Search ..... 355/282, 289, 290, 295; 219/216, 469; 432/60; 100/93 RP

[56] References Cited

U.S. PATENT DOCUMENTS

| | | | |
|---|---|---|---|
| 4,219,327 | 8/1980 | Idstein | 355/290 X |
| 4,753,543 | 6/1988 | Mochimara et al. | 432/60 X |
| 4,802,439 | 2/1989 | Sugimoto et al. | 432/60 X |
| 4,812,873 | 3/1989 | Inagaki et al. | 219/216 X |
| 4,814,819 | 3/1989 | Torino et al. | 355/290 |

FOREIGN PATENT DOCUMENTS

| | | |
|---|---|---|
| 54-21739 | 2/1979 | Japan . |
| 60-205561 | 10/1985 | Japan . |

*Primary Examiner*—Joan H. Pendegrass

*Attorney, Agent, or Firm*—Wenderoth, Lind & Ponack

[57] ABSTRACT

A low pressure heat fixing device for fixing toner images to multilayer paper as well as to ordinary copy paper. The device has a heat fixing roller having a metal roller body, an elastic intermediate layer formed on the surface of the metal roller body, and a thin resin film formed on the surface of the intermediate layer and having a releasing property and thickness less than the intermediate layer, a pressure roller in contact with the heat fixing roller and having a metal roller body, an elastic layer formed on the surface of the metal roller body, and a pressing member for pressing the heat fixing roller and the pressure roller together along a nip line at a total pressure of less than 20 kg to thereby thermally fix an image to a paper passed between the rollers.

7 Claims, 2 Drawing Sheets

LOW PRESSURE HEAT FIXING DEVICE

BACKGROUND OF THE INVENTION

1. Field of the Invention

The present invention relates to a heat fixing device for fixing toner of a copying device and which is for use at a low total pressure of less than 20 kg. The term "total pressure" as used herein refers to the sum of the pressures over the entire length of a roller.

2. Description of the Prior Art

Conventional fixing device of the heat roll type generally in use, for example, those comprising a heat fixing roller and a pressure roller in pressing contact therewith under a pressure of 40 to 150 kg have the problem of creasing paper when fixing images to envelopes or the like having a multilayer structure. To overcome this problem, i.e., to make envelopes or the like usable as copy paper without creasing, some of such fixing devices are adjustable so that the pressure roller is pressed against the heat fixing roller at a low total pressure of less than 20 kg.

FIG. 4 is an enlarged fragmentary sectional view showing a conventional heat fixing roller 1A for use in fixing devices of the heat roll type. The roller 1A comprises a Teflon resin layer 11*a* formed on the surface of a core 10*a* and having a thickness of tens of microns. Since the resin layer 11*a* has almost no elasticity, the roller has high hardness at the portion thereof to be brought into contact with toner T1. Accordingly, the fixing device for use at a low total pressure of less than 20 kg is operable without creasing the paper but exerts too low a pressure on copy paper 3*a*, such as a letterhead, having surface indentations or projections, with the result that a space L1 occurs between the surface of the heat fixing roller 1A and a portion of the toner T1 deposited on the indented portion 31*a* of the surface of copy paper 3*a* as shown in FIG. 4. The heat fixing roller 1A is therefore unable to fully apply its heat and pressure to the toner portion T1, consequently failing to properly fix the toner portion T1 to the copy paper 3*a*. If such improper fixing becomes pronounced, an offset will occur. This phenomenon can be precluded by decreasing the hardness of the heat fixing roller to provide an increased nip width, but this method entails the problem of impairing the proper passage of plain paper through the device.

SUMMARY OF THE INVENTION

The main object of the present invention is to provide a heat fixing device for properly fixing toner images to multilayer paper such as envelopes and also to copy paper, such as letterheads, having a projected image on the surface.

Another object of the invention is to provide a heat fixing device for fixing a toner image to copy paper, such as an envelope or like multilayer paper, with application of heat and pressure by transporting the copy paper, bearing the image formed thereon, in nipping contact therewith under a low total pressure of less than 20 kg so as to obtain a copy free from creases.

These and other objects can be fulfilled by a heat fixing device characterized in that the device has a heat fixing roller comprising a metal roller body, an elastic intermediate layer covering the surface of the metal roller body and a thin resin film covering the surface of the intermediate layer and having a releasing property and a smaller thickness than the intermediate layer, and a pressure roller comprising a metal roller body and an elastic layer covering the surface of the pressure roller body, the fixing roller and the pressure roller being operable to transport copy paper bearing a toner image formed thereon in nipping contact therewith under a total pressure of less than 20 kg to thereby thermally fix the image to the paper.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

Figure 1:
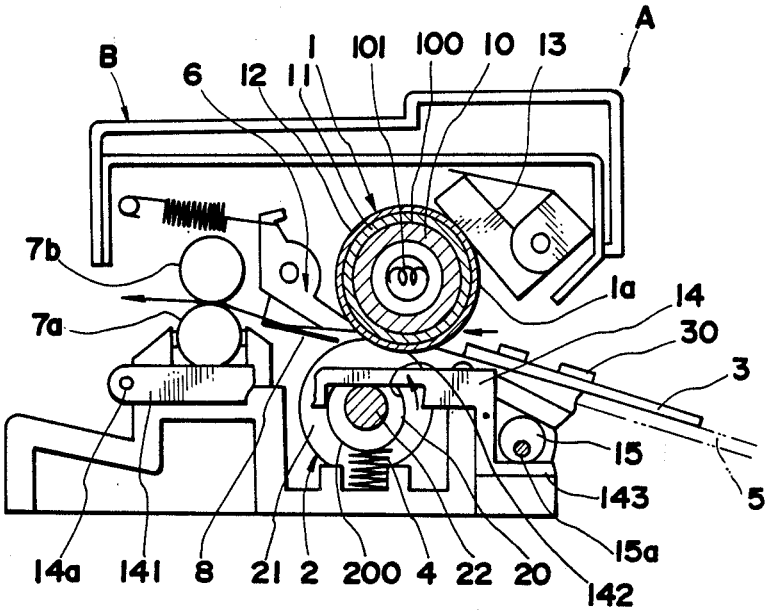
FIG. 1 is an overall side elevation showing a fixing device embodying the invention.
Figure 2:
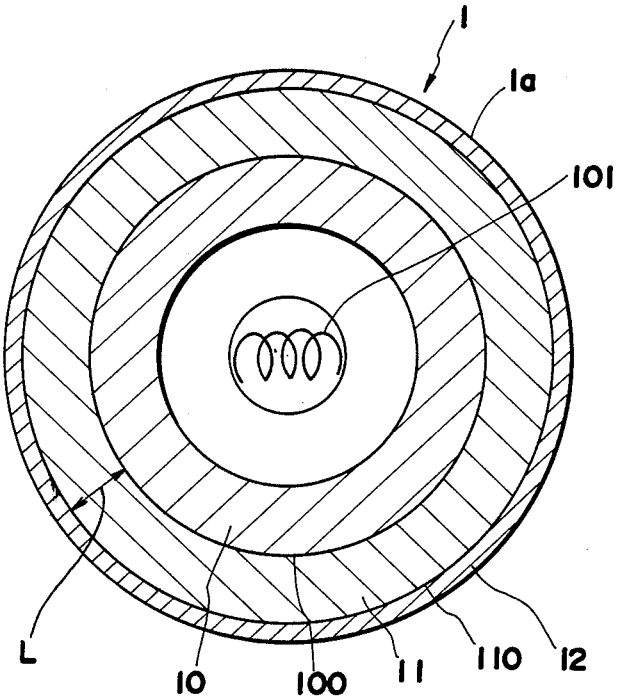
FIG. 2 is an enlarged view in cross section of a heat fixing roller included in the device.
Figure 3:
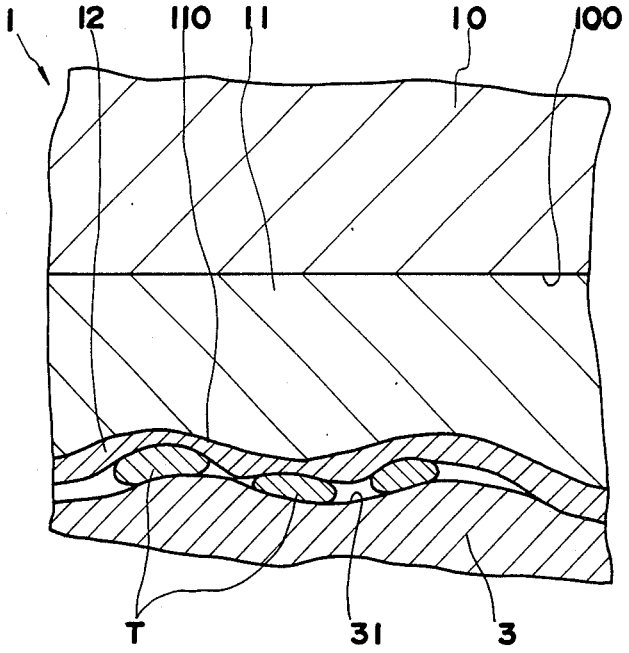
FIG. 3 is an enlarged sectional view of the fixing roller showing how toner is fixed to copy paper.
Figure 4:
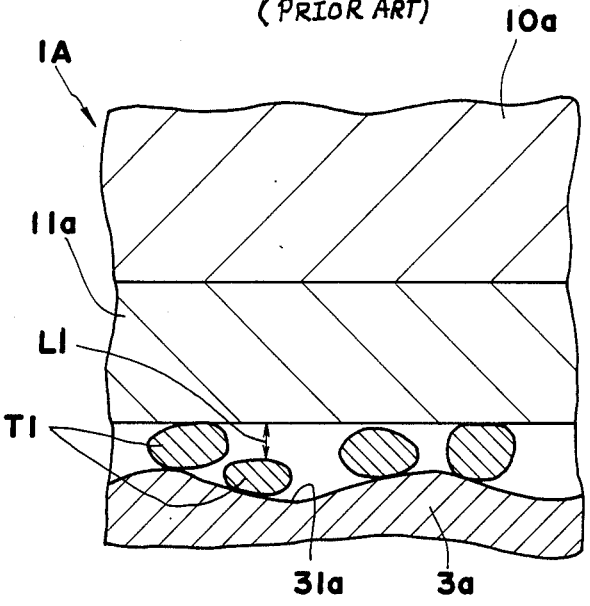
FIG.4 (PRIOR ART)
FIG. 4 is an enlarged sectional view of a conventional heat fixing roller showing how toner is thereby fixed to copy paper.

A heat fixing device embodying the invention will be described with reference to FIG. 1 which is a side elevation showing the device in its entirety, FIG. 2 showing the heat fixing roller of the device in cross section, and FIG. 3 which is an enlarged sectional view showing how toner is fixed to copy paper by the roller.

The present embodiment, i.e. heat fixing device A, comprises a heat fixing roller 1 and a pressure roller 2.

The heat fixing roller 1 and the pressure roller 2 are both accommodated in a housing B for transporting copy paper 3, bearing a toner image 30 formed thereon by a preceding process, in nipping contact therewith under a low total pressure of less than 20 kg to thereby fix the image 30 to the paper 3 with heat and pressure.

The pressure roller 2 is held in pressing contact with the heat fixing roller 1 at an optional low pressure of less than 20 kg which is controllable by adjusting the force of the push spring 4 to be described later.

The heat fixing roller 1 comprises an aluminum roller body or core 10, and an intermediate layer 11 having low hardness and covering the surface 100 of the core 10, a resin film 12 having a releasing property and a thickness smaller than the thickness L of the intermediate layer 11 and covering the surface 110 of the intermediate layer 11. The intermediate layer 11 is made of silicone rubber and is 0.1 mm to 1 mm in thickness. Preferably, the releasing resin film 12 is made of a fluorocarbon resin and is 10 to 100 microns in thickness.

The pressure roller 2 comprises an aluminum roller body or core 20, and a sponge layer 21 covering the surface 200 of the core 20 and about 15 degrees in Asker C hardness.

The heat fixing roller 1 has a heater 101 housed in the core 10 which is hollow. The current to be passed through the heater 101 is controllable by a temperature adjusting thermistor 13 which is in contact with the surface 1*a* of the fixing roller 1 as will be described later.

The pressure roller 2, which has center shafts 22 (only one shaft shown) at its respective ends, is retained within the housing B with the aforementioned push spring 4 provided between the housing B and a portion of each shaft 22. The push spring 4 biases the pressure roller 2 into pressing contact with the heat fixing roller 1 supported by the housing B. The maximum force of the push spring 4 is so predetermined as to hold the pressure roller 2 in pressing contact with the heat fixing roller 1 under a low total pressure of less than 20 kg. A pressure adjusting lever 14 is further disposed within the housing B. The lever 14 has one end 141 supported by a pivot 14*a*, a midportion bearing at its lower edge 142 on the center shaft 22 of the roller 2, and a free end, i.e. the other end, 143 in engagement with a cam 15. The cam is mounted on and rotatable with a rotary shaft 15*a* supported by the housing B. Owing to the eccentricity of the cam 15 relative to the shaft 15*a*, the rotation of the cam 15 pivotally moves the pressure adjusting lever 14 about the pivot 14*a* to shift the other end 143 and also controls the amount of shift of the pressure roller 2 in the direction in which the push spring 4 biases the center shaft 22 of the roller 2 and in a direction opposite to this direction. This varies the pressure of contact between the heat fixing roller 1 and the pressure roller 2. Disposed in front of and to the rear of the combination of fixing roller 1 and pressure roller 2 are a guide member 5 for guiding the copy paper 3 to the nip of the two rollers 1, 2, a pawl 6 for separating the copy paper 3 from the fixing roller 1, a guide 8 for guiding the separated copy paper 3 to delivery rollers 7*a*, 7*b*, etc.

The rotary shaft 15*a* is connected to an unillustrated drive shaft by a clutch (not shown), which is engageable and disengageable by a solenoid (not shown). Upon the actuation of a copy switch (not shown), the solenoid is energized to engage the clutch. This causes the drive shaft to drive the rotary shaft 15*a* and the cam 15, which in turn causes the pressure adjusting lever 14 to depress the pressure roller 2 or release the roller 2 from the depressing force, thereby moving the roller 2 upward or downward. Further only during fixing in a copying operation is the pressure roller 2 brought into pressing contact with the heat fixing roller 1 by the push springs 4 for a fixing operation.

With the fixing device A of the foregoing construction, copy paper 3 having a toner image 30 formed thereon by the preceding process is guided along the guide member 5 and passed between the fixing roller 1 and the pressure roller 2. Consequently, the image bearing copy paper 3 is transported while being nipped on its opposite sides between the fixing roller 1 and the pressure roller 2 at the predetermined low total pressure of less than 20 kg. In this case, the releasing resin film 12 of the roller 1 intimately contacts the surface la of the copy paper 3, which is for example a letterhead or the like, in conformity with the shape of indentations 31 in the paper as seen in FIG. 3 owing to the elasticity of the intermediate layer 11 between the film 12 and the core 10, whereby the portions of toner T in the indentations 31, as well as those on other surface portions of the paper, are fixed to the paper with heat and pressure. The copy paper 3 in intimate contact with the fixing roller 1 is thereafter separated therefrom by the pawl 6, guided along by the guide 8 and delivered onto an outside tray (not shown) by the rollers 7*a*, 7*b*.

Although the fixing roller 1 and the pressure roller 2 of the fixing device are held in contact with each other under a total pressure of less than 20 kg, the letterhead or like copy paper 3 having surface irregularities can be thus intimately contacted with the surface 1*a* of the fixing roller 1 by the elasticity of the intermediate layer 11 and the action of the releasing resin film 12 whose thickness is less than the thickness L of the intermediate layer 11, whereby the heat and pressure can be applied to the toner T.

Accordingly, the fixing device of the invention is adapted to fix toner images to multilayer paper, such as envelopes, without making any crease therein and also to properly fix toner images to copy paper, such as letterheads, having projected or indented images.

Next, an experimental example is given below in which the heat fixing roller 1 of the above embodiment was tested.

EXPERIMENTAL EXAMPLE

An aluminum core, 39.2 mm in diameter and 320 mm in length, was used for the heat fixing roller. A silicone rubber layer, 0.4 mm in wall thickness L, was provided around the core, with a primer coating formed between the rubber layer and the core surface. The rubber layer was then coated with a primer for fluorocarbon resins and thereafter with PFA (MP-10-2, product of Mitsui Fluorochemical Co., Ltd.) electrostatically to a thickness of 30 microns. The resulting roller was heated in an oven set to 280° C. for about 10 minutes, then heated in another oven heated at 350° C. for 15 minutes and thereafter spontaneously cooled in air. The heat fixing roller thus obtained had a fluorocarbon resin coating formed over the silicone rubber layer and having the elastic characteristics of a releasing resin film. The roller was installed in a Minolta copying machine, Model EP-470, as the heat fixing roller of its fixing unit and tested for creasing and toner fixing ability using thick airmail envelopes, thin airmail envelopes, thick letterheads and thin letterheads. The pressure roller used in combination with the heat fixing roller was a roll comprising a metal core having a diameter of 40 mm and a length of 320 mm and a sponge layer covering the the core and 15 degrees in Asker C hardness.

Table 1 shows the test results achieved in comparison with those achieved by the comparative example to be described below.

The test results as to the creasing of paper and toner fixing ability were evaluated according to the following criteria and listed in Table 1 in the symbols given below.

A: Free of any problem

B: Usable substantially free of problem

C: Problem encountered in use

COMPARATIVE EXAMPLE

For use in comparison with the roller of the Experimental Example, a fluorocarbon resin roll having high hardness was prepared by coating an aluminum core, 39.9 mm in diameter and 320 mm in length, with a primer for fluorocarbon resins and then with PFA (MP-10-2, product of Mitsui Fluorochemical Co., Ltd.) electrostatically to a thickness of 30 microns, heating the coated core in an oven set to 400° C. for 40 minutes and thereafter spontaneously cooling the core in air.

The fluorocarbon resin roll was tested in the same fixing unit as in the Experimental Example with the results given in Table 1.

The results of Table 1 reveal that the heat fixing roller and the pressure roller are held in contact with each other preferably at a total pressure of about 11 kg. We have also found that this effect is available most favorably when the intermediate layer of low hardness covering the surface of the core of the fixing roller has a thickness in the range of 0.1 to 1 mm because thicknesses smaller than this range encounter difficulty in imparting elastic characteristics to the intermediate layer and further because thicknesses exceeding this range entail problems in durability.

TABLE 1

| Pressure | | Creasing | | Toner fixing ability | |
|---|---|---|---|---|---|
| | | Thick envelope | Thin envelope | Thick letter-head | Thin letter-head |
| 6.5 kg | Exp. Ex. | A | A | B | B |
| | Comp. Ex. | A | A | C | C |
| 11 kg | Exp. Ex. | A | A | A | A |
| | Comp. Ex. | A | A | C | C |
| 20 kg | Exp. Ex. | B | B | A | A |
| | Comp. Ex. | B | B | C | B |

To sum up, the present invention provides a heat fixing device which comprises a heat fixing roller and a pressure roller for transporting copy paper bearing a toner image formed thereon in nipping contact therewith under a low total pressure of less than 20 kg to thereby fix the toner image to the copy paper, the heat fixing roller comprising a metal roller body, an elastic intermediate layer covering the surface of the metal roller body and a resin film covering the surface of the intermediate layer and having a releasing property and a smaller thickness than the intermediate layer, the pressure roller comprising a metal roller body and an elastic layer covering the surface of the pressure roller body.

Accordingly, even if the copy paper is a letterhead or the like having a projected image thereon, the releasing resin film on the surface of the fixing roller comes into intimate contact with the portions of toner present in the indentations of the paper. More specifically, the elastic intermediate layer covering the core of the fixing roller serves as a cushion, permitting the resin film to deform in conformity with the surface irregularities of the copy paper having the projected image and therefore to come into full contact with the toner portions present in the indentations of the paper, whereby the toner can be fixed to the paper through heat transfer and under the low pressure. Moreover, the toner can be completely fixed also to envelopes or like multilayer paper without making any crease in the paper because of the low pressure.

Further even if a material of low hardness is used for the pressure roller to be brought into contact with the surface of the fixing roller during use, the elastic characteristics of both the fixing roller and the pressure roller assure proper transportability of plain paper.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A low pressure heat fixing device comprising:

a heat fixing roller having a metal roller body, an elastic intermediate layer on the surface of said metal roller body, and a thin resin film formed over the surface of said intermediate layer, said elastic intermediate layer having a thickness of 0.1 mm-1 mm and said thin resin film having a releasing property and a thickness of 10 μm–100 μm and being thinner than said intermediate layer;

a pressure roller in contact with said heat fixing roller and having a metal roller body, and an elastic layer on the surface of said last mentioned metal roller body, and a pressing means for pressing said heat fixing roller and said pressure roller together along a nip line at a total pressure of less than 20 kg to thereby thermally fix an image to a paper passed between said rollers.

2. A heat fixing device as claimed in claim 1 wherein said metal roller body of said fixing roller is aluminum, said elastic intermediate layer is of silicon rubber, and said thin resin file is of a fluorine compound.

3. A heat fixing device as claimed in claim 1 wherein said elastic layer of said pressure roller is sponge.

4. A heat fixing device as claimed in claim 1 wherein said pressure roller has a center shaft at each end thereof, and said pressing means comprises a push spring engaging a portion of each center shaft of said pressure roller for urging said pressure roller into contact with said heat fixing roller.

5. A heat fixing device as claimed in claim 1, wherein said pressure roller has a hardness of about 15 degrees Asker C hardness.

6. A heat fixing device as claimed in claim 1, wherein said pressure roller is deformable where it is in nipping contact with said heat fixing roller under a low total pressure of less than 20 kg to form a nip portion.

7. A heat fixing device as claimed in claim 1, wherein said pressing means comprises means for holding said heat fixing roller and said pressure roller in contact with each other at a total pressure of about 11 kg.

* * * * *